US005853972A

United States Patent [19]

Oyamada et al.

[11] Patent Number: 5,853,972

[45] **Date of Patent: *Dec. 29, 1998**

[54] SILVER HALIDE EMULSION, SILVER HALIDE PHOTOGRAPHIC MATERIAL AND ITS PROCESSING, AND METHODS FORMING IMAGES

[75] Inventors: Takayoshi Oyamada; Seiji Yamashita, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 662,680

[22] Filed: Jun. 14, 1996

Related U.S. Application Data

[63] Continuation of Ser. No. 382,207, Feb. 1, 1995, abandoned.

[30] Foreign Application Priority Data

Feb. 10, 1994 [JP] Japan ..... 6-036313

[51] Int. Cl.[6] ..... G03C 1/035; G03C 1/015; G03C 1/09

[52] U.S. Cl. ..... 430/569; 430/567; 430/603

[58] Field of Search ..... 430/567, 569, 430/603

[56] References Cited

U.S. PATENT DOCUMENTS

| | | | |
|---|---|---|---|
| 5,225,319 | 7/1993 | Fukazawa et al. | 430/567 |
| 5,238,805 | 8/1993 | Saitou | 430/567 |
| 5,288,601 | 2/1994 | Greener et al. | 430/533 |
| 5,320,938 | 6/1994 | House et al. | 430/567 |
| 5,356,764 | 10/1994 | Szajewski et al. | 430/567 |
| 5,393,652 | 2/1995 | Marui | 430/533 |
| 5,437,970 | 8/1995 | Shono | 430/533 |

*Primary Examiner*—Mark F. Huff

*Attorney, Agent, or Firm*—Sughrue, Mion, Zinn, Macpeak & Seas, PLLC

[57] ABSTRACT

A tabular silver halide emulsion having a Cl content of 10% or more, which has high covering power, high sensitivity and low fogging property, prepared by adding fine silver halide grains in an amount corresponding to 20% or more of the total silver amount under the condition of pH 5.5 or more and/or pCl 1.6 or more during the course of growth of crystals after nucleation to allow the crystals to grow, and a photographic material using the same, and further a method for developing the photographic material and an image-forming method.

7 Claims, 1 Drawing Sheet

SILVER HALIDE EMULSION, SILVER HALIDE PHOTOGRAPHIC MATERIAL AND ITS PROCESSING, AND METHODS FORMING IMAGES

This is a Continuation of application Ser. No. 08/382,207 filed Feb. 1, 1995, now abandoned.

FIELD OF THE INVENTION

The present invention relates to a silver halide photographic emulsion having high sensitivity, low fogging and high covering power (optical density per a unit developing silver amount), and further to a silver halide photographic material containing the emulsion which are excellent in rapid processing property.

The present invention also relates to a method for processing the above-mentioned silver halide photographic material, and particularly to a method for processing a black and white photographic material with a developing agent different from hydroquinone, using an automatic developing machine. Further, the present invention relates to a processing method in which a photographic material can be developed with a decreased replenishment rate of the developing solution per a unit area thereof.

Furthermore, the present invention relates to a photographic material having sufficient stiffness even though a support is thin, and having excellent handling properties when formed into a sheet-like shape.

Moreover, the present invention relates to a method for forming excellent X-ray images by a combination of the above-mentioned silver halide photographic material and a fluorescent material.

BACKGROUND OF THE INVENTION

There are quite a number of prior-art techniques regarding tabular grains having a high silver chloride content. Examples of the tabular grains having a (111) plane as a principal plane are described in JP-B-64-8326 (the term "JP-B" as used herein means an "examined Japanese patent publication"), JP-B-64-8325, JP-B-64-8324, JP-A-1-250943 (the term "JP-A" as used herein means an "unexamined published Japanese patent application"), JP-B-3-14328, JP-B-4-81782, JP-B-5-40298, JP-B-5-39459, JP-B-5-12696, JP-A-63-213836, JP-A-63-218938, JP-A-63-281149 and JP-A-62-218959.

Prior-art techniques of the tabular grains having a (100) plane as a principal plane are described in JP-A-5-204073, JP-A-51-88017, JP-A-63-24238, etc. In particular, it is described in JP-A-6-59360 and Japanese Patent Application No. 5-264059 that the growth of grains is conducted in the presence of fine grains through the Ostwald ripening, but nevertheless with no description of its conditions (pH, pCl, etc.). Further, in these prior-art techniques, it is also not described that the Ostwald ripening in the presence of fine grains is effective for preventing generation of fog inherent in silver chloride. In these prior techniques, tabular grains having a high silver chloride content are formed by using additives (crystal habit controlling agents for silver halide) or formed under specially selected conditions for the growth of crystals. However, the growth of crystals under such conditions has the unnegligible disadvantage of generating fog. As a result of intensive studies, the present inventors have discovered that the growth of grains under the conditions of pH 5.5 or more and/or pCl 1.6 or more is important to the growth of tabular grains, specifically to the growth of tabular grains with high aspect ratios which have a (100) plane as a principal plane and have a high silver chloride content, whereas the growth of grains under such circumstances often leads to generation of fog. The present inventors have further discovered that these tabular grains are very liable to generate fog, when chemical sensitization, especially chemical sensitization by use of a selenium sensitizer or a tellurium sensitizer, is conducted.

The present inventors have discovered that, when the growth of grains is conducted through the Ostwald ripening associated with dissolution of fine grains of silver halide under the conditions of pH 5.5 or more or pCl 1.6 or more, tabular silver halide grains having a high silver chloride content particularly reduce generation of fog. Further, the thus-grown grains have been found to reduce generation of fog, particularly when sensitization using a selenium sensitizer or a tellurium sensitizer is effected. Furthermore, it has been found that, when grains have a (100) plane as a principal plane, anisotropic growth is accelerated in the direction parallel to the principal plane to form tabular grains with a high aspect ratio.

Up to date, black and white silver halide photographic materials generally used (for X-ray photography, plate making, microphotography, negative materials, etc.) are developed with an alkaline developing solution containing hydroquinone as a developing agent and a 3-pyrazolidone compound or an aminophenol compound as a auxiliary developing agent, followed by processing consisting of a fixing step and a washing (stabilizing) step, thereby forming images.

Among these, photographic materials for X-ray photography contain a relatively large amount of silver halide, and is rapidly processed as well, so that a highly active developing solution containing a large amount of hydroquinone as the developing agent are used. Further, the developing solution characteristically contains glutaraldehyde as a hardening agent. In order to maintain the high activity of such a developing solution, a large quantity of replenisher has been used, withstanding air oxidation. However, the toxicity and hygienic safety of hydroquinone itself have now raised as a problem. Sulfites used for protecting hydroquinone from oxidation dissolve silver halide in developing solutions and are reduced therein, thereby causing so-called silver stains. Accordingly, substitutes for the sulfites have been required. One of them is ascorbic acids as described in U.S. Pat. No. 2,688,549 and JP-A-3-249756, but these compounds have the crucial disadvantage of forming acids by hydrolysis in alkaline developing solutions to lose their developing activity increasingly.

Ascorbic acids originally have only low developing activity and are insufficient in rapid processability.

No method to evade the intrinsic problem inherent in ascorbic acids has hitherto been known. A concentrated liquid for a developing solution (a kit of processing agents) which is used as the developing solution after mixing would practically have no problem as a commercial product, if its performance is guaranteed for about two years. However, if ingredients contained in the concentrated liquid for the alkaline developing solution contain ascorbic acids, it may have already lost the developing activity when used. It has not known yet how to use ascorbic acids in place of , hydroquinone, and they have not been practically used till now. In order to provide them the practical performance, various improvements would be required particularly in their stability.

Black and white silver halide photographic materials are usually processed according to the steps of development, fixing, washing and drying, after exposure. Recently, almost all of the photographic materials are processed using an automatic developing machine. In that case, the photographic materials are appropriately processed under the conditions that a developing solution is placed in contact with air in a development tank of the automatic developing machine. It has been desired that the stability thereof is high when such processing is done. Further, it has been desired to make an amount of replenisher required per a unit area of the photographic material smaller. For example, about 330 ml or more of the developing solution has usually been replenished per $m^2$ of so-called sheet-like photographic material such as an X-ray photograph or a sensitive material for graphic art.

However, waste photographic developing solutions have a high chemical oxygen demand (so-called COD) and a high biochemical oxygen demand (so-called BOD), and therefore, are drained after making them harmless by chemical or biological treatment. The treatment of these waste developing solutions requires a heavy economical burden.

On the other hand, as the performance on the photographic material side, silver halide emulsions which show stable processability even by processing liquids of low activity and also endure rapid processing have been developed.

However, conventional emulsion techniques offer insufficient performance to developing solutions containing ascorbic acid and its derivatives. It has been quite unexpected that sensitive materials of the present invention show particularly excellent performance in the developing solutions containing ascorbic acid and its derivatives.

Celluloses such as polyethylene terephthalate or triacetyl cellulose have conventionally been used for supports. However, when these supports are coated, stored in roll form and thereafter cut into sheets, they often have the disadvantage of curling.

In many cases, for example, these supports have been required to have a thickness of 170 $\mu$m or more for medical X-ray image-forming films which are conveyed on rollers during development, because of low stiffness. In such thick supports, when films having light-sensitive emulsion layers on the both sides thereof are placed between fluorescent materials and subjected to exposure, diffusion and scattering of light become significant to cause images to be liable to blur, while light emitted from the fluorescent material of the front side reaches to the back side.

Methods of forming images in combination with a fluorescent material having a main peak of emission at 400 nm or less are described in, for example, U.S. Pat. No. 5,173,611 and WO93/01521. As is seen in Ultra Vision System manufactured by Du Pont, some examples thereof are commercialized and marketed. However, it has been quite unexpected that a sensitive material comprising a fluorescent material having a main peak of emission at 400 nm or less and tabular grain emulsions of the present invention having high silver chloride content and low fogging property exhibit excellent photographic performance.

SUMMARY OF THE INVENTION

Objects of the present invention are (1) to provide a photographic emulsion comprising tabular silver halide grains which have a high covering power, a low fogging property, and a high silver chloride content; (2) to provide the tabular silver halide grains described in item (1) having a high sensitivity; (3) to provide a photographic material showing good photographic performance in a developing solution comprising ascorbic acid or a derivative thereof; (4) to provide the above-described photographic material which does not curl with time in roll form after coating, and to obtain a photographic image which are slightly blurred by crossover light, and (5) to obtain a good X-ray photographic image in combination with a fluorescent material.

As a result of intensive studies, the present inventors have found that the above-described objects can be achieved by the following means:

1. A tabular silver halide emulsion having a Cl content of 10% or more prepared by adding fine silver halide grains in an amount corresponding to 20% or more of the total silver amount under the condition of pH 5.5 or more during the course of growth of crystals after nucleation to allow the crystals to grow;

2. A tabular silver halide emulsion having a Cl content of 10% or more prepared by adding fine silver halide grains in an amount corresponding to 20% or more of the total silver amount under the condition of pCl 1.6 or more during the course of growth of crystals after nucleation, and subjecting to physical ripening to allow the crystals to grow;

3. A tabular silver halide emulsion having a Cl content of 10% or more prepared by adding fine silver halide grains in an amount corresponding to 20% or more of the total silver amount under the condition of pH 5.5 or more and pCl 1.6 or more during the course of growth of crystals after nucleation to allow the crystals to grow;

4. A method for developing a silver halide photographic material, in which the silver halide photographic material having at least one light-sensitive silver halide emulsion layer containing a tabular silver halide emulsion as described in the above items 1, 2 and 3 respectively are processed with a developing solution containing ascorbic acid or a derivative thereof;

5. A silver halide photographic material comprising a support having thereon at least one light-sensitive silver halide emulsion layer containing the tabular silver halide emulsion as described in the above items 1, 2 and 3 respectively and the support containing polyethylene naphthalate (PEN); and 6. An image-forming method which comprises exposing the silver halide photographic material as described in the above item 5 with a fluorescent material having a main peak of emission at 400 nm or less, and processing the exposed photographic material with the method of the above item 4.

Figure 1:
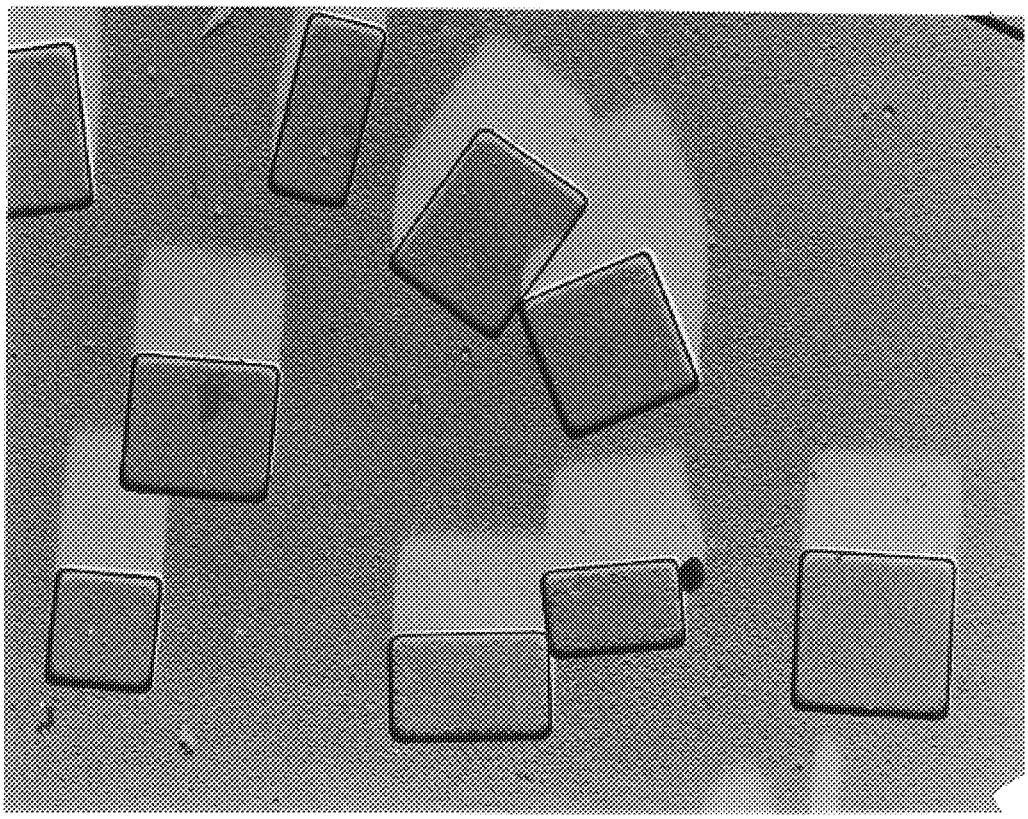
FIG. 1 is a transmission electron microscopic photograph showing the crystal structure of silver halide grains in Emulsion C of Example 1 of the present invention.

The magnification thereof is 20,000X.

DETAILED DESCRIPTION OF THE INVENTION

The present invention will be described in detail below.

In a silver halide emulsion containing at least a dispersion medium and silver halide grains, generally 50% or more, preferably from 60% to 100%, and more preferably from 70% to 100% of the whole projected area of the silver halide grains have a $Cl^-$ content of generally 10 mol % or more, preferably from 20 to 100 mol %, more preferably from 30 to 100 mol %, and most preferably from 40 to 100 mol %, and the silver halide grains are tabular grains each having a (100) plane as a principal plane. Herein, the tabular grains mean grains having an aspect ratio (diameter/thickness) of 2 or more. The principal plane means the maximum outer surface (i.e., the surface which has the widest area among the crystal surfaces of the crystal) of the tabular grain. The tabular grains have a thickness of generally 0.35 μm or less, preferably from 0.05 to 0.3 μm, and more preferably from 0.05 to 0.25 μm. The average aspect ratio is generally 2 or more, preferably from 2 to 25, and more preferably from 4 to 20. Herein, the diameter means a diameter of a circle having an area equivalent to a projected area of the tabular grain, and the thickness means a distance between the two principal planes. The average aspect ratio is an average value of aspect ratios of the whole tabular grains having aspect ratios of 2 or more.

Of the emulsions of the present invention, the nucleation of emulsions having a (111) plane as a principal planes is described in detail in JP-B-64-8326, JP-B-64-8325, JP-B-64-8324, JP-A-1-250943, JP-B-3-14328, JP-B-4-81782, JP-B- 5-40298, JP-B-5-39459, JP-B-5-12696, JP-A-63-213836, JP-A-63-218938, JP-A-63-281149, JP-A-62-218959, etc., and prior-art techniques of tabular grains having a (100) plane as a principal planes are described in JP-A-5-204073, JP-A-51-88017, JP-A-63-24238, Japanese Patent Application No. 5-264059, etc.

In the present invention, methods of nucleation described in these prior-art references can be arbitrarily used.

Methods for allowing crystals to grow by physical ripening (fine grains are dissolved and substrate grains are grown) in the presence of fine silver halide grains of the present invention are described below.

In the fine grain emulsion addition method, the growth of tabular grains are effected through the Ostwald ripening, by adding an emulsion of fine AgX grains having a diameter of generally 0.15 μm or less, preferably 0.1 μm or less, and more preferably from 0.06 to 0.006 μm. The fine grain emulsion can be added continuously or successively. The fine grain emulsion is continuously prepared by feeding an $AgNO_3$ solution and an $X^-$ salt solution into a mixer provided in the vicinity of a reaction vessel and immediately added continuously to the reaction vessel, or the fine grain emulsion is previously prepared in another vessel by a batch operation and thereafter can be added thereto continuously or successively. The fine grain emulsion can be added in the liquid state or as dried powder. The dried powder can also be mixed with water just before addition to liquidize, followed by addition. The addition is preferably conducted so that the fine grains added can disappear within 20 minutes, and more preferably in the range of from 10 seconds to 10 minutes. Prolonged disappearance undesirably generates ripening between the fine grains, causing the grain size to increase. Accordingly, it is preferred not to add the whole amount of the fine grains at once. It is preferred that the fine grains do not substantially contain multiple twin grains. The term "multiple twin grain" means a grain having 2 or more twin planes per one grain. The term "do not substantially contain" means a number ratio of multiple twin grains of generally 5% or less, preferably 1% or less, and more preferably 0.1% or less. Further, it is preferred that the fine grains also do not substantially contain single twin grains. Furthermore, it is preferred that the fine grains do not substantially contain screw dislocation. Here again, "do not substantially contain" follows the same rule as that mentioned above.

The halogen components of the fine grains include AgCl, AgBr, AgBrI (the $I^-$ content is preferably 10 mol % or less, and more preferably 5 mol % or less), and mixed crystals consisting of 2 or more kinds of them. As to other details, the description of JP-A-6-59360 can be referred.

The total amount of the fine grains to be added is generally 20% or more, preferably 40% or more, and more preferably from 50% to 98%, based on the total amount of silver halides.

The Cl content of the fine grains is preferably 10% or more, and more preferably from 50% to 100%.

Conventional dispersion media for AgX emulsions can be used as dispersion medium used in nucleating, ripening and growing, and particularly, the use of gelatin containing methionine in a content of preferably from 0 to 50 μmol/g and more preferably from 0 to 30 μmol/g, is preferred. The use of gelatin in ripening and growing makes it possible to form thinner tabular grains having an uniform distribution in diameter size. Further, synthetic polymers described in JP-B-52-16365, *Nippon Shashin Gakkai Shi,* vol. 29 (1), p 17 and 22 (1966), ibid., vol. 30 (1), p 10 and 19 (1967), ibid., vol. 30 (2), p 17 (1967), and ibid., vol. 33 (3), p 24 (1967) can be preferably used as dispersion media. In the growing step due to addition of the fine grains, the pH is 5.5 or more, preferably from 6 to 10, and more preferably from 6 to 9.

The pCl is 1.6 or more, preferably 1.8 or more, and more preferably from 2.0 to 3.0.

These growing conditions are preferred particularly for the tabular grains having the (100) planes as the principal planes.

The pCl is defined by the following equation:

$$pCl=-\log[Cl^-]$$

wherein $[Cl^-]$ is an activity of $Cl^-$ ion in a solution. This is described in detail in T. H. James, *THE THEORY OF THE PHOTOGRAPHIC PROCESS,* the fourth edition, the first chapter.

When the pH is decreased to less than 5.5, for example, in the case of the tabular grains having the (100) planes as the principal planes, the growth in the horizontal direction is inhibited to lower the aspect ratio, resulting in a tendency to reduce the covering power of the emulsion and to lower the sensitivity. When the pH is 5.5 or more, the growing speed in the horizontal direction increases to heighten the aspect ratio, resulting in the increased covering power of the emulsion, but in a tendency to increase the fogging property and to lower the sensitivity.

When the pCl is less than 1.6, the growth in the vertical direction is promoted to lower the aspect ratio, resulting in the lowered covering power of the emulsion and the lowered sensitivity. When the pCl is 1.6 or more, the aspect ratio is heightened, resulting in the increased covering power, but in a tendency to increase the fogging property and to lower the sensitivity. However, it has been found that, when the substrate grains are allowed to grow by the fine silver halide grains, the low fogging property, the high sensitivity, the high aspect ratio and the higher covering power can be attained even at pH 5.5 or more and/or at pCl 1.6 or more.

With respect to the monodispersibility of the emulsions of the present invention, the degree of monodispersion is preferably 30% or less and more preferably from 5% to 25%, when considered on the base of the coefficient of variation defined by the method described in JP-A-59-745481. In particular, when hard photographic materials are used, it is preferably from 5% to 15%.

Selenium sensitization and tellurium sensitization is described below. They may be used singly or in combination. In particular, preferred examples of theses uses and compounds are described in detail in JP-A-3-116132, JP-A-5-113635, JP-A-5-165136, JP-A-5-165137, JP-A-5-134345, etc.

Particularly preferred examples of selenium sensitizers used include compounds represented by formulas (I) and (II) described in JP-A-5-165137 and Compounds I-1 to I-20 and II-1 to II-19 described therein. Particularly preferred examples of tellurium sensitizers include compounds represented by formulas (IV) and (V) described in JP-A-5-134345 and Compounds IV-1 to IV-22 and V-1 to V-16 described therein.

In the present invention, a support containing polyethylene naphthalate (PEN) is preferably used.

As polyethylene naphthalate (PEN), polyethylene-2,6-naphthalate is preferred.

The term "polyethylene-2,6-naphthalate" used in the present invention means a polymer substantially composed of repeating structure units of ethylene-2,6-naphthalenedicarboxylate. Examples thereof include polyethylene-2,6-dicarboxylate not copolymerized, copolymers in which preferably 10% or less and more preferably 5% or less of the repeating structure units are modified by other components, mixtures with other polymers, and compositions.

Polyethylene-2,6-naphthalate is synthesized by combining naphthalene-2,6-dicarboxylic acid or its functional derivative with ethylene glycol or its functional derivative in the presence of a catalyst under suitable conditions, and further polyethylene-2,6-naphthalate used in the present invention may be a copolymer or a mixed polyester prepared by adding one or more kinds of third components (modifiers) before completion of polymerization thereof. The suitable third components include compounds having divalent ester-formable functional groups, for example, dicarboxylic acids such as oxalic acid, adipic acid, phthalic acid, isophthalic acid, terephthalic acid, naphthalene-2,7-dicarboxylic acid, succinic acid and diphenyl ether dicarboxylic acid, or their lower alkyl esters; oxycarboxylic acids such as p-oxybenzoic acid and p-oxyethoxybenzoic acid, or their lower alkyl esters; and dihydric alcohols such as propylene glycol and trimethylene glycol. Polyethylene-2,6-naphthalate or modified polymers thereof may be those of which the terminal hydroxyl group and/or carboxylic group is blocked by a monofunctional compound such as benzoic acid, benzoylbenzoic acid, benzoyloxybenzoic acid or methoxypolyalkylene glycol, or those modified by a very small amount of a trifunctional or tetrafunctional compound such as glycerin or pentaerythritol to an extent that substantially linear copolymers can be formed.

The photographic material of the present invention fully exhibits the effect, particularly when it contains at least one silver halide emulsion layer on each the both sides of the support.

Application of the present invention to the photographic materials having the emulsion layers on the both sides of the support makes it possible to obtain images with high image quality and high sharpness, besides the above-mentioned effect, and further to have the unexpected effect that tanks and rollers are not stained, when the replenishment rate is reduced during development processing.

As chemical sensitization, it is possible to use so-called gold sensitization using gold compounds, sensitization using metals such as iridium, platinum, rhodium or palladium, sulfur sensitization using sulfur-containing compounds, reduction sensitization using stannous salts or polyamines, sensitization using selenium compounds, sensitization using tellurium compounds, or combinations of 2 or more kinds of these sensitizing methods. The tabular silver halide grains can be prepared by appropriate combinations of methods known in the art.

As to the photographic materials of the present invention, the amount of silver is preferably from 0.5 to 5 g/m$^2$ (at one side), and more preferably from 1 to 3.4 g/m$^2$ (at one side).

For rapid processing, it is preferred that the amount of silver does not exceed 5 g/m$^2$.

There is no particular limitation on various additives used for the photographic materials of the present invention. For example, additives described in the corresponding portions of JP-A-2-68539 shown below can be used.

| Item | Corresponding Portion |
|---|---|
| 1. Silver Halide Emulsions and Preparation Thereof | JP-A-2-68539, page 8, lower right column, line 6 from the bottom to page 10, upper right column, line 12 |
| 2. Chemical Sensitization | page 10, upper right column, line 13 to lower left column, line 16 |
| 3. Antifoggants and Stabilizers | page 10, lower left column, line 17 to page 11, upper left column, line 7; page 3, lower left column, line 2 to page 4, lower left column |
| 4. Color Sensitizers | page 4, lower right column, line 4 to page 8, lower right column |
| 5. Surfactants and Antistatic Agents | page 11, upper left column, line 14 to page 12, upper left column, line 9 |
| 6. Matting Agents, Lubricants and Plasticizers | page 12, upper left column, line 10 to upper right column, line 10 |
| 7. Hydrophilic Colloids | page 12, upper right column, line 11 to lower left column, line 16 |
| 8. Hardeners | page 12, lower left column, line 17 to page 13, upper right column, line 6 |
| 9. Supports | page 13, upper right column, line 7 to line 20 |
| 10. Dyes and Mordants | page 13, lower left column, line 1 to page 14, lower left column, line 9 |

Preferred examples of the methods for forming images using the photographic materials of the present invention include a method for forming images in combination with a fluorescent material having a main peak preferably at 400 nm or less (i.e., the fluorescent material which is subjected to emission in the neighborhood of the peak by irradiation of X-ray), and more preferably a method for forming images in combination with a fluorescent material having a main peak in the region of 380 nm or less.

As the screens each having a main peak of emission at 400 nm or less, screens described in JP-A-6-11804 and WO93/01521 can be used, but the present invention is not limited to these screens.

The replenishment rate of the processing solutions is preferably 10 ml/25.4 cm×30.5 cm or less, and more preferably 4 ml/25.4 cm×30.5 cm or less, thereby exhibiting the effect markedly.

As ascorbic acid and its derivatives used in the developing solutions in the present invention, compounds represented by formula (I) described in JP-A-5-165161 and Compounds I-1 to I-8 and II-9 to II-12 described therein are particularly preferred.

The ascorbic acid compounds used in the developing solutions in the present invention are generally known as compounds of the endiol type, the enaminol type, the endiamine type, the thiol-enol type and the enamine-thiol type. Examples of these compounds are described in U.S. Pat. No. 2,688,549, JP-A-62-237443, etc. Methods for synthesizing these ascorbic acid compounds are also well known, and described in, for example, Tuguo Nomura and Hirohisa Ohmura, *Chemistry of Reductone,* Uchida Rokakuho Shinsha, 1969.

The ascorbic acid compounds used in the present invention can be used also in the form of alkali metal salts such as lithium salts, sodium salts or potassium salts. These ascorbic acid compounds are preferably used in an amount of 1 to 100 g per liter of developing solution, and more preferably in an amount of 5 to 80 g per liter.

In the present invention, particularly, 1-phenyl-3-pyrazolidones or p-aminophenols are preferably used together with the ascorbic acid compounds.

Examples of the 3-pyrazolidone-based developing agents used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-hydroxymethyl-3-pyrazolidone.

Examples of the p-aminophenol-based developing agents used in the present invention include N-methyl-p-aminophenol, p-aminophenyl, N-(β-hydroxyethyl)-p-aminophenol, N-(4-hydroxyphenyl)glycine, 2-methyl-p-aminophenol and p-benzylaminophenol, and among them, N-methyl-p-aminophenol is preferred.

In general, the developing agents are preferably used in an amount of 0.001 to 1.2 mol/liter.

Alkali agents used for pH adjustment include pH adjustors such as sodium hydroxide, potassium hydroxide, sodium carbonate, potassium carbonate, sodium tertiary phosphate and potassium tertiary phosphate.

Examples of sulfites used as preservatives for the developing solutions of the present invention include sodium sulfite, potassium sulfite, lithium sulfite, ammonium sulfite, sodium bisulfite and potassium metabisulfite. The amount of sulfites to be used is preferably 0.01 mol/liter or more, and more preferably 0.02 mol or more. The upper limit is preferably 2.5 mol/liter.

Besides these, preservatives described in L. F. A. Maison, *Photographic Processing Chemistry,* Focal Press, pp 226–229 (1966), U.S. Pat. Nos. 2,193,015 and 2,592,364, JP-A-48-64933, etc. may also be used.

In general, the developing solutions often contain boric acid compounds (for example, boric acid and borax) as pH buffers. However, it is preferred that the ascorbic acid-containing developing solutions used in the present invention does not substantially contain boric acid compounds. That is, it is particularly preferred that the amount of the boric acid compounds contained is 0.1 g/l less.

The processing solutions used in the present invention can be chemically mixed according to the methods described in JP-A-61-177132, JP-A-3-134666 and JP-A-3-67258.

In the processing methods of the present invention, the developing solutions can be replenished by the method described in JP-A-5-216180.

It is more preferred that, when dry-to-dry processing is conducted within 100 seconds, a roller of rubber material as described in JP-A-63-151943 is used as an outlet roller of a developing tank to prevent uneven development inherent in rapid processing, that the extrusion flow rate for stirring the developing solution in the tank is adjusted to 10 m/minute or more as described in JP-A-63-151944, and that the developing solution is stirred more intensively at least during development processing than during standing-by as described in JP-A-63-264758.

In the methods for developing the photographic materials of the present invention, there is no particular limitation on photographic materials, and general black and white photographic materials are mainly used. The methods can also be used particularly for photographic materials for the laser source, photographic materials for printing, medical direct X-ray photographic materials, medical photofluorographic materials, CRT image-recording photographic materials, microfilms, photographic materials for general photographing, etc. The present invention will be described in detail below with reference to examples.

EXAMPLE 1

Preparation of Emulsions A to K of the Present Invention and Emulsions L to O for Comparison In a reaction vessel were placed 1,582 ml of an aqueous solution of gelatin having pH 4.3, containing 19.5 g of Gelatin-1 (deionized alkali-treated bone gelatin having a methionine content of about 40 μmol/g) and 7.8 ml of a 1N-solution of $HNO_3$ and 13 ml of an NaCl-1 Solution (containing 10 g of NaCl per 100 ml), and while maintaining the temperature at 40° C., 15.6 ml of an Ag-1 Solution (containing 20 g of $AgNO_3$ per 100 ml) and 15.6 ml of an X-1 Solution (containing 7.05 g of NaCl per 100 ml) were simultaneously added thereto at a rate of 62.4 ml/minute and then mixed. After stirring for 3 minutes, 28.2 ml of an Ag-2 Solution (containing 2 g of $AgNO_3$ per 100 ml) and 28.2 ml of an X-2 Solution (containing 1.4 g of KBr per 100 ml) were simultaneously mixed at a rate of 80.6 ml/minute. After stirring for 3 minutes, 46.8 ml of the Ag-1 Solution and 46.8 ml of the X-1 Solution were simultaneously added thereto at a rate of 62.4 ml/minute and then mixed. After stirring for 2 minutes, 203 ml of an aqueous solution of gelatin (containing 13 g of Gelatin-1, 1.3 g of NaCl, and a 1N-solution of NaOH for adjusting the pH to the values shown in Table 1) was added thereto to adjust the pCl to the values shown in Table 1. Then, the temperature was elevated to 75° C. and the pCl was adjusted as shown in Table 1 and then ripening was conducted for 42 minutes. A fine AgCl grain emulsion (average grain diameter: 0.1 μm) was added at an addition rate of AgCl of $2.68\times10^{-2}$ mol/min over a 20-minute period. After the mixture was subjected to ripening for 10 minutes after addition, a precipitant was added thereto, and the mixture was cooled to 35° C. to wash the precipitates with water. An aqueous solution of gelatin was added to adjust the pH value to 6.0 at 60° C. Replicas of the grains were observed under a transmission electron microscope (hereinafter abbreviated as "TEM"). The resulting emulsion comprised (100) tabular grains having a high content of silver chloride which contain 0.44 mol % of AgBr based on silver. The shape characteristics of the grains are shown in Table 2. A photograph of Emulsion C observed under the TEM is shown in FIG. 1.

[The whole projected area of (100) tabular grains having an aspect ratio of 2 or more/the sum of projected area of the whole AgX grains]×100=$a_1$

[The average aspect ratio of (100) tabular grains having an aspect ratio of 2 or more (average diameter/average thickness)]=$a_2$

[The average diameter of (100) tabular grains having an aspect ratio of 2 or more]=$a_3$ (the average thickness)=$a_4$

TABLE 1

| Emulsion | pH | pCl (40° C.) | pCl (75° C.) | Note |
|---|---|---|---|---|
| A | 4.3 | 2.15 | 2.00 | Invention |
| B | 5.3 | 2.15 | 2.00 | Invention |
| C | 5.5 | 2.15 | 2.00 | Invention |
| D | 7.8 | 2.15 | 2.00 | Invention |
| E | 4.3 | 1.70 | 1.60 | Invention |
| F | 5.5 | 1.70 | 1.60 | Invention |
| G | 7.8 | 1.70 | 1.60 | Invention |
| H | 7.8 | 1.52 | 1.43 | Invention |
| I | 5.5 | 1.40 | 1.33 | Invention |
| J | 7.8 | 1.40 | 1.33 | Invention |
| K | 9.0 | 2.33 | 2.17 | Invention |
| L | 4.3 | 1.52 | 1.43 | Comparison |
| M | 5.3 | 1.52 | 1.43 | Comparison |
| N | 4.3 | 1.40 | 1.33 | Comparison |
| O | 5.3 | 1.40 | 1.33 | Comparison |

TABLE 2

| Emulsion | $a_1$ | $a_2$ | $a_3$ | $a_4$ |
|---|---|---|---|---|
| A | 89 | 3.8 | 0.57 | 0.15 |
| B | 87 | 4.9 | 0.73 | 0.15 |
| C | 86 | 7.2 | 1.15 | 0.16 |
| D | 95 | 10.0 | 1.26 | 0.17 |
| E | 86 | 4.1 | 0.74 | 0.18 |
| F | 88 | 6.7 | 1.21 | 0.18 |
| G | 93 | 8.0 | 1.39 | 0.19 |
| H | 85 | 4.2 | 0.92 | 0.22 |
| I | 78 | 3.7 | 0.93 | 0.25 |
| J | 77 | 4.1 | 1.07 | 0.26 |
| K | 98 | 11.0 | 1.18 | 0.12 |
| L | 74 | 3.1 | 0.90 | 0.29 |
| M | 77 | 3.3 | 0.89 | 0.27 |
| N | 71 | 2.3 | 0.85 | 0.37 |
| O | 73 | 2.6 | 0.91 | 0.35 |

Preparation of Emulsions P to Y for Comparison:

In a reaction vessel were placed 1,582 ml of an aqueous solution of gelatin having pH 4.3, containing 19.5 g of Gelatin-1 (deionized alkali-treated bone gelatin having a methionine content of about 40 $\mu$mol/g) and 7.8 g of a 1N solution of $HNO_3$ and 13 ml of an NaCl-1 Solution (containing 10 g of NaCl per 100 ml), and while maintaining the temperature at 40° C., 15.6 ml of an Ag-1 Solution (containing 20 g of $AgNO_3$ per 100 ml) and 15.6 ml of an X-1 Solution (containing 7.05 g of NaCl per 100 ml) were simultaneously added thereto at a rate of 62.4 ml/minute and then mixed. After stirring for 3 minutes, 28.2 ml of an Ag-2 Solution (containing 2 g of $AgNO_3$ per 100 ml) and 28.2 ml of an X-2 Solution (containing 1.4 g of KBr per 100 ml) were simultaneously mixed at a rate of 80.6 ml/min. After stirring for 3 minutes, 46.8 ml of the Ag-1 Solution and 46.8 ml of the X-1 Solution were simultaneously added thereto at a rate of 62.4 ml/minutes and then mixed. After stirring for 2 minutes, 203 ml of an aqueous solution of gelatin (containing 13 g of Gelatin-1, 1.3 g of NaCl, and a 1N-solution of NaOH for adjusting the pH to the values shown in Table 3) was added thereto to adjust the pCl to the values shown in Table 3, and thereafter the temperature was elevated to 75° C. and ripening was conducted for 42 minutes. While maintaining the pCl at 75° C. at the values shown in Table 3, an Ag-3 Solution (containing 50 g of $AgNO_3$ per 100 ml) and an X-3 Solution (containing 17.6 g of NaCl per 100 ml) were added thereto at a constant flow rate over a 20-minute period using a controlled double jet, until the quantity of the Ag-3 Solution added reached 182 ml. The resulting emulsion comprised (100) tabular grains having a high content of silver chloride which contain 0.44 mol % of AgBr based on silver. The shape characteristics of the grains are shown in Table 4.

TABLE 3

| Emulsion | pH | pCl (40° C.) | pCl (75° C.) | Note |
|---|---|---|---|---|
| P | 4.3 | 2.15 | 2.00 | Comparison |
| Q | 5.5 | 2.15 | 2.00 | Comparison |
| R | 7.8 | 2.15 | 2.00 | Comparison |
| S | 4.3 | 1.70 | 1.60 | Comparison |
| T | 5.5 | 1.70 | 1.60 | Comparison |
| U | 7.8 | 1.70 | 1.60 | Comparison |
| V | 4.3 | 1.52 | 1.43 | Comparison |
| W | 5.5 | 1.52 | 1.43 | Comparison |
| X | 7.8 | 1.52 | 1.43 | Comparison |
| Y | 9.0 | 2.33 | 2.17 | Comparison |

TABLE 4

| Emulsion | $a_1$ | $a_2$ | $a_3$ | $a_4$ |
|---|---|---|---|---|
| P | 81 | 3.6 | 0.72 | 0.20 |
| Q | 82 | 6.1 | 1.14 | 0.19 |
| R | 90 | 6.4 | 1.33 | 0.20 |
| S | 80 | 3.2 | 0.64 | 0.20 |
| T | 84 | 5.7 | 1.20 | 0.21 |
| U | 88 | 6.2 | 1.43 | 0.23 |
| v | 63 | 3.O | 0.76 | 0.36 |
| w | 62 | 2.4 | 0.79 | 0.33 |
| x | 67 | 2.6 | 0.81 | 0.31 |
| Y | 87 | 7.O | 1.16 | 0.14 |

Chemical Sensitization:

grains A to Y thus-prepared were subjected to chemical sensitization with stirring and maintaining at 60° C. First, $1\times10^{-4}$ mol of thiosulfonic acid Compound-1 per mol of silver halide was added, and then, fine AgBr grains having a diameter of 0.10 $\mu$m was added in an amount of 1.0 mol % based on the total amount of silver, and $1\times10^{-6}$ mol of thiourea dioxide per mol of Ag was further added. The mixture was allowed to stand as such for 22 minutes, and subjected to reduction sensitization. Then, $3\times10^{-4}$ mol of 4-hydroxy-6-methyl-1,3,3a,7-tetraazaindene per mol of Ag, Sensitizing Dye-1 and Sensitizing Dye-2 were each added. Further, calcium chloride was added. Subsequently, sodium thiosulfate ($6\times10^{-6}$ mol per mol of Ag) and tellurium Compound III-12 ($4\times10^{-6}$ mol per mol of Ag) were added. Furthermore, $1\times10^{-5}$ mol of chloroauric acid per mol of Ag and $1\times10^{-3}$ mol of potassium thiocyanate per mol of Ag were added, and after the elapse of 40 minutes, the mixture was cooled to 35° C.

Thus, the preparation of the emulsions (chemical ripening) was terminated.

Thiosulfonic Acid Compound-1

$C_2H_5SO_2SNa$

Sensitizing Dye-1

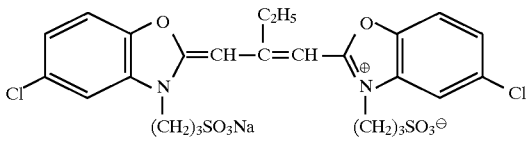

1 x $10^{-3}$ mol per mol of Ag

-continued

Sensitizing Dye-2

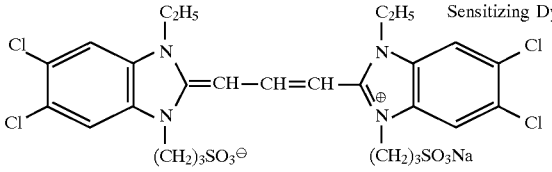

1 x $10^{-5}$ mol per mol of Ag (Preparation of Emulsion Coating Layers)

The following chemicals per mol of silver halide were added to the emulsions subjected to chemical sensitization to prepare emulsion coating solutions.

| | |
|---|---|
| Gelatin (containing also gelatin in the emulsion) | 111 g |
| Dextran (average molecular weight: 39,000) | 21.5 g |
| Polysodium acrylate (average molecular weight: 400,000) | 5.1 g |
| Polysodium styrenesulfonate (average molecular weight: 600,000) | 1.2 g |
| Hardener 1,2-bis (vinylsulfonylacetamide)-ethane | |

The amount to be added was adjusted so that the degree of swelling reached 230%

| | |
|---|---|
| Compound-I | 42.1 mg |
| Compound-II | 10.3 g |
| Compound-III | 0.11 g |
| Compound-IV | 8.5 mg |
| Compound-V | 0.43 g |
| Compound-VI | 0.004 g |
| Compound-VII | 0.1 g |
| Compound-VIII | 0.1 g |

The pH was adjusted to 6.1 with NaOH.

Compound-I

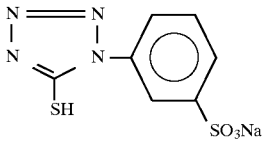

Compound-II

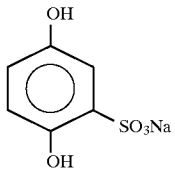

Compound-III

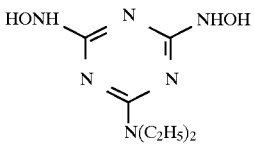

Compound-IV

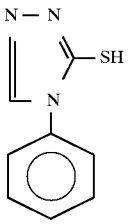

-continued

Compound-V

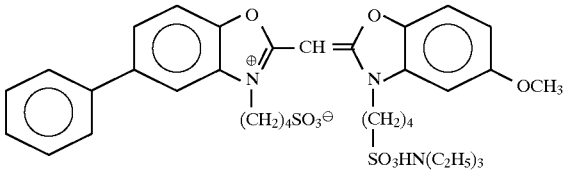

Compound-VI

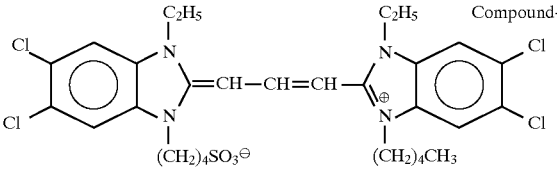

Compound-VII

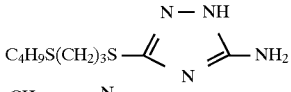

Compound-VIII

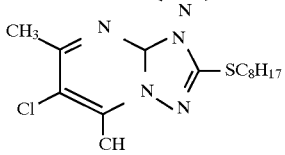

Dye emulsion A was added to the above-mentioned coating solution so as to give an amount of Dye-I of 10 Mg/$m^2$ at one side.

Dye-1

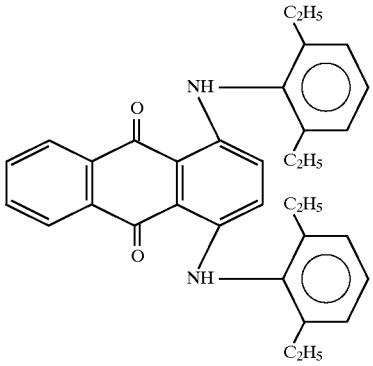

(Preparation of Dye Emulsion A)

Sixty grams of Dye-I described above were dissolved in 62.8 g of the following High-Boiling Organic Solvent-I, 62.8 g of High-Boiling Organic Solvent-II and 333 g of ethyl acetate at 60° C. Then, 65 ml of a 5% aqueous solution of sodium dodecylsulfonate, 94 g of gelatin and 581 ml of water were added thereto, and the mixture was emulsified at 60° C. for 30 minutes using a dissolver. Thereafter, 2 g of the following Compound-VI and 6 liters of water were added, and the mixture was cooled to 40° C. The resulting mixture was concentrated using an Ultrafiltration Labomodule ACP1050 (manufactured by Asahi Chemical Industry) until the whole amount reached 2 kg, and 1 g of Compound-VI described above was added to prepare Dye Emulsion A.

High-Boiling Organic Solvent-I

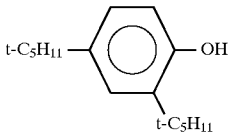

-continued

High-Boiling Organic Solvent-II

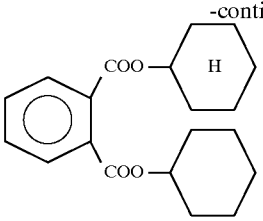

Compound-VI

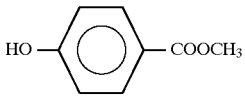

(Preparation of Coating Solution for Surface Protecting Layer)

A coating solution for a surface protecting layer was prepared so as to give the following amount of each component coated.

| | |
|---|---|
| Gelatin | 0.780 g/m$^2$ |
| Polysodium acrylate (average molecular weight: 400,000) | 0.035 g/m$^2$ |
| Polysodium styrenesulfonate (average molecular weight: 600,000) | 0.0012 g/m$^2$ |
| Polymethyl methacrylate (average particle diameter: 3.7 $\mu$m) | 0.072 g/m$^2$ |
| Coating Aid-I | 0.020 g/m$^2$ |
| Coating Aid-II | 0.037 g/m$^2$ |
| Coating Aid-III | 0.0080 g/m$^2$ |
| Coating Aid-IV | 0.0032 g/m$^2$ |
| Coating Aid-V | 0.0025 g/m$^2$ |
| Compound-IX | 0.0022 g/m$^2$ |
| Proxel | 0.0010 g/m$^2$ |

The mixture was adjusted to pH 6.8 with NaOH.

Coating Aid-I

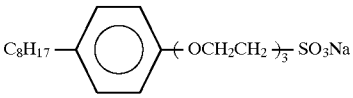

Coating Aid-II

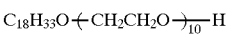

Coating Aid-III

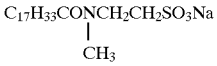

Coating Aid-IV

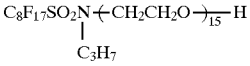

Coating Aid-V

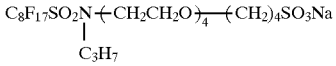

Compound-IX

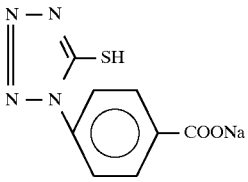

(Preparation of Support)

(1) Preparation of Dye Dispersion B for Undercoat Layer

Dye-II described below was treated with a ball mill according to the method described in JP-A-63-197943.

Dye-II

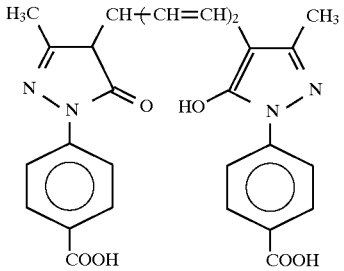

In a 2-liter ball mill were placed 434 ml of water and 791 ml of a 6.7% aqueous solution of Triton X200 (registered trademark), a surfactant [TX-200 (registered trademark)]. Then, 20 g of the dye was added to the solution. To the mixture was added 400 ml of beads (diameter: 2 mm) of zirconium oxide ($ZrO_2$), and the contents were pulverized for 4 days. Thereafter, 160 g of 12.5% gelatin was added. After defoaming, the $ZrO_2$ beads were removed by filtration. A result of observation of the resulting dye dispersion showed that the pulverized dye has a wide particle size distribution of from 0.05 to 1.15 $\mu$m and an average particle size of 0.37 $\mu$m. In addition, the dye particles having a particle size of 0.9 $\mu$m or more were removed by centrifuging, thus obtaining Dye Dispersion B.

(2) Preparation of Support

A biaxially oriented polyethylene terephthalate film having a thickness of 175 $\mu$m was subjected to corona discharge, and coated with a first undercoating solution having the following composition with a wire converter so as to give an amount coated of 4.9 ml/m$^2$, followed by drying at 185° C. for 1 minute.

Then, a first undercoating layer was similarly formed also on the opposite surface. Polyethylene terephthalate containing 0.04% by weight of Dye-I was used.

| | |
|---|---|
| Butadiene-Styrene Copolymer Latex Solution (solid content: 40%, weight ratio of butadiene/styrene = 31/69) | 158 ml |
| 4% Solution of Sodium Salt of 2,4-Dichloro-6-hydroxy-s-triazine | 41 ml |
| Distilled Water | 801 ml |

*The latex solution contains 0.4% by weight of the following compound as an emulsification dispersing agent, based on the latex solid content.

Emulsification Dispersing Agent

Containing

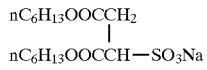

in an amount of 0.4% by weight based on the solid content of latex (3) Coating of Undercoating Layers The second undercoating layers having the following composition were coated on the above-described first undercoating layers on the both surfaces, respectively, using a wire bar coater system, so as to provide the amounts coated described below, and dried at 155° C.

| | |
|---|---|
| Gelatin | 80 mg/m$^2$ |
| Dye Dispersion B (as solid dye) | 8 mg/m$^2$ |
| Coating Aid-VI | 1.8 mg/m$^2$ |
| Compound-X | 0.27 mg/m$^2$ |
| Matting Agent (Polymethyl methacrylate having an average particle diameter of 2.5 $\mu$m) | 2.5 mg/m$^2$ |

Coating Aid-VI $C_{12}H_{25}O(CH_2CH_2O)_{10}H$

Compound-X

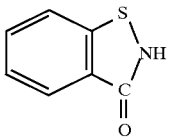

(Preparation of Photographic Materials)

The thus-prepared support was coated on the both surfaces with a combination of the above-described emulsion layer and surface-protecting layer by the extrusion technique. The weight of silver coated per one surface was 1.75 g/m$^2$.

(Evaluation of Photographic Performance)

The photographic materials were exposed for a period of 0.05 second from the both sides using a X-ray Orthoscreen HR-4 (manufactured by Fuji Photo Film Co., Ltd.). After exposure, the sensitivity was evaluated using the following automatic processing machine and processing solutions. The sensitivity was shown as the logarithm of the reciprocal of an exposure amount required to give the density of fog +0.1, and was here represented by relative values to the sensitivity of Emulsion A which was taken as 100.

(Processing)

Automatic processing machine: CEPROS-M (manufactured by Fuji Photo Film Co., Ltd.) was converted to incorporate a heat roller into a drying zone and the conveying speed was accelerated up to 30 seconds in dry-to-dry processing.

Preparation of Concentrated Solution:

| (Developing Solution) | |
|---|---|
| Part Agent A: | |
| Potassium Hydroxide | 330 g |
| Potassium Sulfite | 630 g |
| Sodium Sulfite | 255 g |
| Potassium Carbonate | 90 g |
| Boric Acid | 45 g |
| Diethylene Glycol | 180 g |
| Diethylenetriamine Pentaacetate | 30 g |
| 1-(N,N-Diethylamino)ethyl-5-mercapto tetrazole | 0.75 g |
| Hydroquinone | 450 g |
| 4-Hydroxymethyl-4-methyl-1-phenyl-3-pyrazolidone | 60 g |
| Water to make | 4,125 ml |
| Part Agent B: | |
| Diethylene Glycol | 525 g |
| 3,3'-Dithiobishydrocinnamic Acid | 3 g |
| Glacial Acetic Acid | 102.6 g |
| 2-Nitroindazole | 3.75 g |
| 1-Phenyl-3-pyrazolidone | 34.5 g |
| Water to make | 750 ml |
| Part Agent C: | |
| Glutaraldehyde (50 wt/wt %) | 150 g |
| Potassium Bromide | 15 g |

-continued

| (Developing Solution) | |
|---|---|
| Potassium Metabisulfite | 105 g |
| Water to make | 750 ml |
| (Fixing Solution) | |
| Ammonium Thiosulfate (70 wt/vol %) | 3,000 ml |
| Disodium Ethylenediaminetetraacetate Dihydrate | 0.45 g |
| Sodium Sulfite | 225 g |
| Boric Acid | 60 g |
| 1-(N,N-Diethylamine)ethyl-5-mercaptotetrazole | 15 g |
| Tartaric Acid | 48 g |
| Glacial Acetic Acid | 675 g |
| Sodium Hydroxide | 225 g |
| Sulfuric Acid (36 N) | 58.5 g |
| Aluminum Sulfate | 150 g |
| Water to make | 6,000 ml |
| pH | 4.68 |

(Preparation of Processing Solutions)

The following vessel was filled with the respective part agents of the above-described concentrated developing solution. The vessel has respective sectional vessels for Part Agents A, B and C which are linked to one another.

A similar vessel was filled with the above-described concentrated fixing solution.

First, 300 ml of an aqueous solution containing 54 g of acetic acid and 55.5 g of potassium bromide was added as a starter to a developing tank.

The vessel filled with the above-described processing agents was turned upside down and pushed in a boring blade of a stock tank for processing solution mounted on the side of the APM to break a sealing film on a cap, and the stock tank was filled with the respective processing agents in the vessel.

A developing tank and a fixing tank of the APM were filled with the respective processing agents by operation of respective pumps mounted thereto in the following ratios.

Every time the 8 photographic materials converted to 25.4 cm×30.5 cm were processed, stock solutions of the respective processing agents were mixed with water in these ratios, and replenished to the processing tanks of the APM.

| | |
|---|---|
| Developing solution: | |
| Part Solution A | 51 ml |
| Part Solution B | 10 ml |
| Part Solution C | 10 ml |
| Water | 125 ml |
| pH | 10.50 |
| Fixing Solution: | |
| Concentrated Solution | 80 ml |
| Water | 20 ml |
| pH | 4.62 |

The washing tank was filled with city water.

Three bottles formed of polyethylene each was filled with 0.4 g of pearlite with an average particle diameter of 100 $\mu$m and an average pore diameter of 3 $\mu$m on which Actinomycetes were supported as a scale inhibitor (the opening of each bottle was covered with a 300-mesh nylon cloth so that water and the fungi pass through the cloth). Two bottles of them were placed on the bottom of the washing tank and the other bottle was placed on the bottom of the stock tank (the liquid volume: 0.2 liter).

| Processing speed and Processing Temperature: | | |
|---|---|---|
| Development | 35° C. | 8.8 seconds |
| Fixing | 32° C. | 7.7 seconds |
| Washing | 17° C. | 3.8 seconds |
| Squeeze | | 4.4 seconds |
| Drying | 58° C. | 5.3 seconds |
| Total | | 30 seconds |
| Amount of Replenisher | | |
| Developing Solution | | 25 ml/10 × 12 inches |
| Fixing Solution | | 25 ml/10 × 12 inches |

The results are shown in Table 5.

TABLE 5

| Coated Emulsion | Sensitivity | Fog |
|---|---|---|
| A | 100 | 0.04 |
| B | 133 | 0.04 |
| C | 178 | 0.04 |
| D | 215 | 0.05 |
| E | 94 | 0.04 |
| F | 166 | 0.04 |
| G | 198 | 0.04 |
| H | 102 | 0.04 |
| I | 95 | 0.04 |
| J | 99 | 0.04 |
| K | 238 | 0.05 |
| L | 74 | 0.04 |
| M | 75 | 0.04 |
| N | 67 | 0.04 |
| O | 71 | 0.04 |
| P | 90 | 0.06 |
| Q | 95 | 0.08 |
| R | 90 | 0.10 |
| S | 60 | 0.05 |
| T | 30 | 0.06 |
| U | 80 | 0.07 |
| V | 58 | 0.06 |
| W | 63 | 0.07 |
| X | 66 | 0.11 |
| Y | 95 | 0.20 |

Surprisingly, the results show that Emulsions C, D, F, G, H, I, J and K prepared at pH 5 or more according to the fine AgCl grain addition method have lower fogging property and higher sensitivity than Emulsions Q, R, T, U, W, X and Y prepared at pH 5.5 or more according to the solution addition method (i.e., the Add'n method).

Surprisingly, the results also show that Emulsions A to G and K prepared at pCl 1.60 or more according to the fine AgCl grain addition method have lower fogging property and higher sensitivity than Emulsions P to U and Y prepared at pCl 1.60 or more according to the solution addition method (i.e., the Add'n method).

Further surprisingly, the results show that Emulsions C, D, F, G and K prepared at pH 5.5 or more and at pCl 1.60 or more according to the fine AgCl grain addition method have lower fogging property and much higher sensitivity than Emulsions Q, R, T, U and Y prepared at pH 5.5 or more and at pCl 1.60 or more according to the solution addition method (i.e., the Add'n method). It is clearly seen that this tendency becomes more significant with higher pH and higher pCl. The fine AgCl grain addition method at a pH of less than 5.5 and at a pCl of less than 1.6 gives lower fogging property, but lower sensitivity.

EXAMPLE 2

Coated samples were prepared in the same manner as in Example 1, except that selenium Compound-I and tellurium Compound-I each was added in an amount of $3\times10^{-6}$ Mol per mol of Ag, separately, during chemical sensitization of the emulsions.

Selenium Compound-I

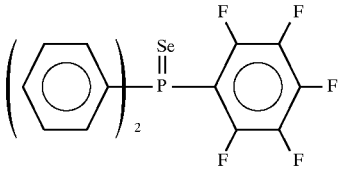

Tellurium Compound-I

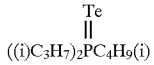

The results of sensitometry carried out quite similarly to Example 1 showed that the emulsions formed according to the present invention have high sensitivity and low fogging property.

EXAMPLE 3

Photographic materials were prepared in the same manner as in Examples 1 and 2, except that the support was replaced by a PEN (polyethylene naphthalate) support prepared in the manner as described below. As a result, the photographic materials generated little curl, even when stored in roll form after coating, and little blur of images by crossover light, when the emulsion layers were coated on the both sides, Support A: Commercially available polyethylene-2,6-naphthalate was melted at 300° C., extruded from a T-type die, subjected to a 3.3-fold longitudinal orientation and subsequently a 3.3-fold crosswise orientation at 140° C., and further subjected to thermal fixing at 250° C. for 6 seconds to obtain a film of 140 $\mu$m in thickness.

Support B: Pellets of polyethylene terephthalate and polyethylene-2,6-naphthalate were previously dried in vacuo at 150° C. for 4 hours, and then kneaded and extruded at 280° C. using a twin-screw extruder to form into pellets. Films for Support B were formed of the pellets similarly to Support A.

Each support was subjected to the corona discharge. The supports of 30 cm in width were treated by the corona discharge treatment using a Solid State Corona Treatment Machine 6KVA Model (manufactured by Pylar Co.). At this time, the support to be treated was treated at 0.375 KV·A·min/m$^2$ from the readings of the current and voltage. The discharge frequency was 9.6 KHz in processing, and the gap clearance between an electrode and a dielectric roll was 1.6 mm.

Undercoating layers were formed in the same manner as in Example 1.

EXAMPLE 4

The photographic materials prepared in Example 1 to 3 were treated with the following developing solution.

[Processing with Automatic Processing Machine]

An automatic processing machine, ("Fuji X-Ray Processor CEPROS-M" manufactured by Fuji Photo and Film Co., Ltd.) was converted in a drive shaft so that the whole processing time became 30 seconds. The drying blow-off temperature was set at 55° C.

Formulation of Developing Solution:

| | |
|---|---|
| Part A: | |
| Potassium Hydroxide | 18.0 g |
| Potassium Sulfite | 30.0 g |
| Sodium Carbonate | 30.0 g |
| Diethylene Glycol | 10.0 g |
| Diethyltriamine Pentaacetate | 2.0 g |
| 1-(N,N-Diethylamino)ethyl-5-mercapto-tetrazole | 0.1 g |
| L-Ascorbic Acid | 43.2 g |
| 4-Hydroxymethyl-4-methyl-1-phenyl-3-pyrazolidone | 2.0 g |
| Water to make | 300 ml |
| Part B: | |
| Triethylene Glycol | 45.0 g |
| 3-3'-Dithiobishydrocinnamic Acid | 0.2 g |
| Glacial Acetic Acid | 5.0 g |
| 5-Nitroindazole | 0.3 g |
| 1-Phenyl-3-pyrazolidone | 3.5 g |
| Water to make | 60 ml |
| Part C: | |
| Glutaraldehyde (50%) | 10.0 g |
| Potassium Bromide | 4.0 g |
| Potassium metabisulfite | 10.0 g |
| Water to make | 50 ml |

A mixture of 300 ml of Part A, 60 ml of Part B and 50 ml of Part C was made up to 1 liter with water, and adjusted to pH 10.90.

A CE-DF1 bottle (manufactured by Fuji Photo Film Co., Ltd.) was filled with 4.50 liters of Part A, 0.90 liter of Part B and 0.75 liter of Part C and used for a 1.5-liter working solution.

Development Starting Solution:

A solution obtained by adding acetic acid to the above-mentioned developing replenisher to adjust the pH to 10.20 was used as a development starting solution.

As a fixing solution was used CE-F1 (manufactured by Fuji Photo Film Co., Ltd.).

| | |
|---|---|
| Developing Temperature | 35° C. |
| Fixing Temperature | 35° C. |
| Drying Temperature | 55° C. |

For each sample, 600 film sheets having a size of 10×12 inches were subjected to running processing at a replenishment rate of 25 ml/10×21 inches (325 ml/m$^2$) (both the developing solution and the fixing solution). That is, the replenishment rate for the 600 film sheets is (25 ml×600 sheets) ml. As a result, satisfactory results were obtained.

When the photographic materials of the present invention are combined with the developing solution, the sensitivity of the running solution satisfactorily remained unchanged from the beginning.

EXAMPLE 5

Images were formed on the photographic materials prepared in Examples 1 to 3 (provided that the emulsions for the photographic material prepared, each was prepared by adding a total amount of silver nitrate during preparation of emulsion, and then adding 2.5 g of PLURONIC 31R1 (manufactured by BASF Co., Ltd.), and further desalting in a vessel having an inner diameter of 60 cm) by X-ray exposure using fluorescent screens as described in JP-A-6-11804. As a result, the formation of good X-ray images was ascertained.

While the invention has been described in detail and with reference to specific embodiments thereof, it will be apparent to one skilled in the art that various changes and modifications can be made therein without departing from the spirit and scope thereof.

What is claimed is:

1. A method for preparing a tabular silver halide emulsion having a Cl content of from 40 to 100 mol %, said method comprising adding fine silver halide grains in an amount corresponding to from 50 to 87% of the total silver amount under the condition of pH 5.5 or more and pCl 1.6 or more during the course of growth of crystals after nucleation, and subjecting the crystals to physical ripening to allow the crystals to grow, wherein the emulsion comprises tabular silver halide grains each having a (100) plane as a principal plane, and wherein the Cl content of said fine silver halide grains is from 50 to 100%.

2. The method for preparing a silver halide emulsion as claimed in claim 1, wherein the tabular silver halide emulsion is subjected to chemical sensitization with a selenium compound and/or a tellurium compound.

3. The method for preparing a silver halide emulsion as claimed in claim 1, wherein the emulsion comprises tabular silver halide grains each having an average aspect ratio of 2 or more.

4. The method for preparing a silver halide emulsion as claimed in claim 1, wherein said condition of pH is from 6 to 10.

5. The method for preparing a silver halide emulsion as claimed in claim 1, wherein said condition of pH is from 6 to 9.

6. The method for preparing a silver halide emulsion as claimed in claim 1, wherein said condition of pCl is from 2.0 to 3.0.

7. The method for preparing a silver halide emulsion as claimed in claim 1, wherein said condition of pH and pCl is from 6 to 10 and from 2.0 to 3.0, respectively.

* * * * *